US005807172A

United States Patent [19]

Piechowiak

[11] Patent Number: 5,807,172

[45] Date of Patent: Sep. 15, 1998

[54] THREE REEL SLOT MACHINE WITH NINE WAYS TO WIN

[75] Inventor: Robert J. Piechowiak, Las Vegas, Nev.

[73] Assignee: Sigma Game Inc., Las Vegas, Nev.

[21] Appl. No.: 699,026

[22] Filed: Aug. 15, 1996

[51] Int. Cl.[6] ..... G07F 17/34

[52] U.S. Cl. ..... 463/20; 273/143 R

[58] Field of Search ..... 463/1, 16, 20; 273/143 R; 364/410, 412

[56] References Cited

U.S. PATENT DOCUMENTS 5,580,053 12/1996 Crouch ..... 463/20
5,611,535 3/1997 Tiberio ..... 273/143 R

FOREIGN PATENT DOCUMENTS

A-30128/95 3/1996 Australia .

*Primary Examiner*—Jessica Harrison
*Assistant Examiner*—Mark A. Sager
*Attorney, Agent, or Firm*—Skjerven, Morrill, MacPherson, Franklin & Friel LLP; Brian Ogonowsky

[57] ABSTRACT

A method for operating a slot machine is described herein which allows a player nine ways to win for a 3-reel slot machine. A total of nine paylines are provided across the array, each payline identifying a unique combination of symbol positions. The display glass of the slot machine contains colored lines interconnecting the symbol positions for each activated payline. The individual paylines are illuminated as each coin is deposited.

5 Claims, 6 Drawing Sheets

THREE REEL SLOT MACHINE WITH NINE WAYS TO WIN

FIELD OF THE INVENTION

This invention relates to slot machines and, in particular, to an award criteria for paying out an award to a player.

BACKGROUND OF THE INVENTION

FIG. 1 illustrates the well known basic circuitry of a modern slot machine 10 which incorporates rotating reels. In such a slot machine 10, each of the reels 12, 13, and 14 has a variety of symbols printed on its periphery. Each of the reels 12–14 is driven by a separate stepper motor 16 which rotates in response to pulses from a CPU 18.

The number of pulses delivered to each stepper motor 16 determines the stopping positions of the reels 12–14 and thus determines the award to be paid out to the player. In modern slot machines, the stopping positions of the reels 12–14 are predetermined using a random number generator consisting of a random number generator program in the program ROM 20 carried out by the CPU 18. The required number of pulses to the three stepper motors are then generated to display the symbol combination at the predetermined reel positions.

In one common type of slot machine, the number of pulses are counted to determine the final position of the reels. In another type of machine, each of the reels has tabs that are sensed by a photodetector to determine the angular displacement of the reel and thus the final displayed symbol. Other means for detecting the positions of the reels exist and are well known.

A money detector 22, which may detect coins or other currency, issues a command to the CPU 18 that the slot machine 10 is ready to be played. The player may then pull a handle 24 or press a button to initiate play.

After the reels have stopped, and the CPU 18 determines the final stop positions, the stop positions are then applied to a pay-table ROM 26, which cross-references the final displayed symbols with a monetary payout to the player. This payout is then conveyed to a payout mechanism 28 which issues coins or credits to the player. A display 30 may also be activated, signalling a win to the player.

The above general description of a modern slot machine would be well known in the art, and such a programmable machine offers great advantages. Slot machines are varied by simply changing the operating program in the program ROM 20 and the award program in the pay-table ROM 26. The front glass of the slot machine is also changeable to convey particular features of the machine.

Additional detail of such conventional slot machines is found in U.S. Pat. No. 4,095,795 to Saxton et. al.; 4,448,419 to Telnaes; and 4,573,681 to Okada, all incorporated herein by reference.

One well known award criteria for a 3-reel slot machine is the matching of symbols in a horizontal or diagonal direction across the display screen. A slot machine 34 incorporating such an award criteria is illustrated in FIG. 2. The display area of slot machine 34 is enlarged in FIG. 3 and shows the symbols on reels 36, 37, and 38. In such a slot machine, three consecutive symbols on each reel are displayed and provides the player with five possible ways to win. Typically, the player must deposit extra coins to obtain a payout for symbols matching on other than the center line. The front glass of the slot machine typically has printed thereon the horizontal and diagonal lines 40, illustrated in FIGS. 2 and 3, to readily convey to the user the win possibilities.

Although the slot machine of FIG. 2 is very attractive to players due to the added possibilities of winning, even more player appeal would be created by allowing the player additional possibilities for winning.

SUMMARY

A method for operating a slot machine is described herein which allows a player nine ways to win for a 3-reel slot machine. The invention may be implemented by relatively minor changes in the software code in the program ROM and the pay-table ROM of a conventional slot machine.

In the preferred embodiment, three consecutive symbols in each of three reels are displayed to create a 3-by-3 array of symbols. An award may be given for a symbol combination in a horizontal direction, in a diagonal direction, or in four additional patterns. These four additional patterns include two upper corner symbols in combination with the center symbol, two lower corner symbols in combination with the center symbol, two outer symbols in the middle row in combination with an upper middle symbol, and two outer symbols in the middle row in combination with a lower middle symbol. Using such an award criteria, a player may deposit up to nine coins to take advantage of all nine paylines. This adds excitement to the player as well as enhanced revenue to the operator of the gaming machine.

The display glass of the slot machine contains colored lines interconnecting the symbol positions for each activated payline. The individual paylines are illuminated as each coin is deposited.

DETAILED DESCRIPTION OF THE PREFERRED EMBODIMENT

Figure 4:
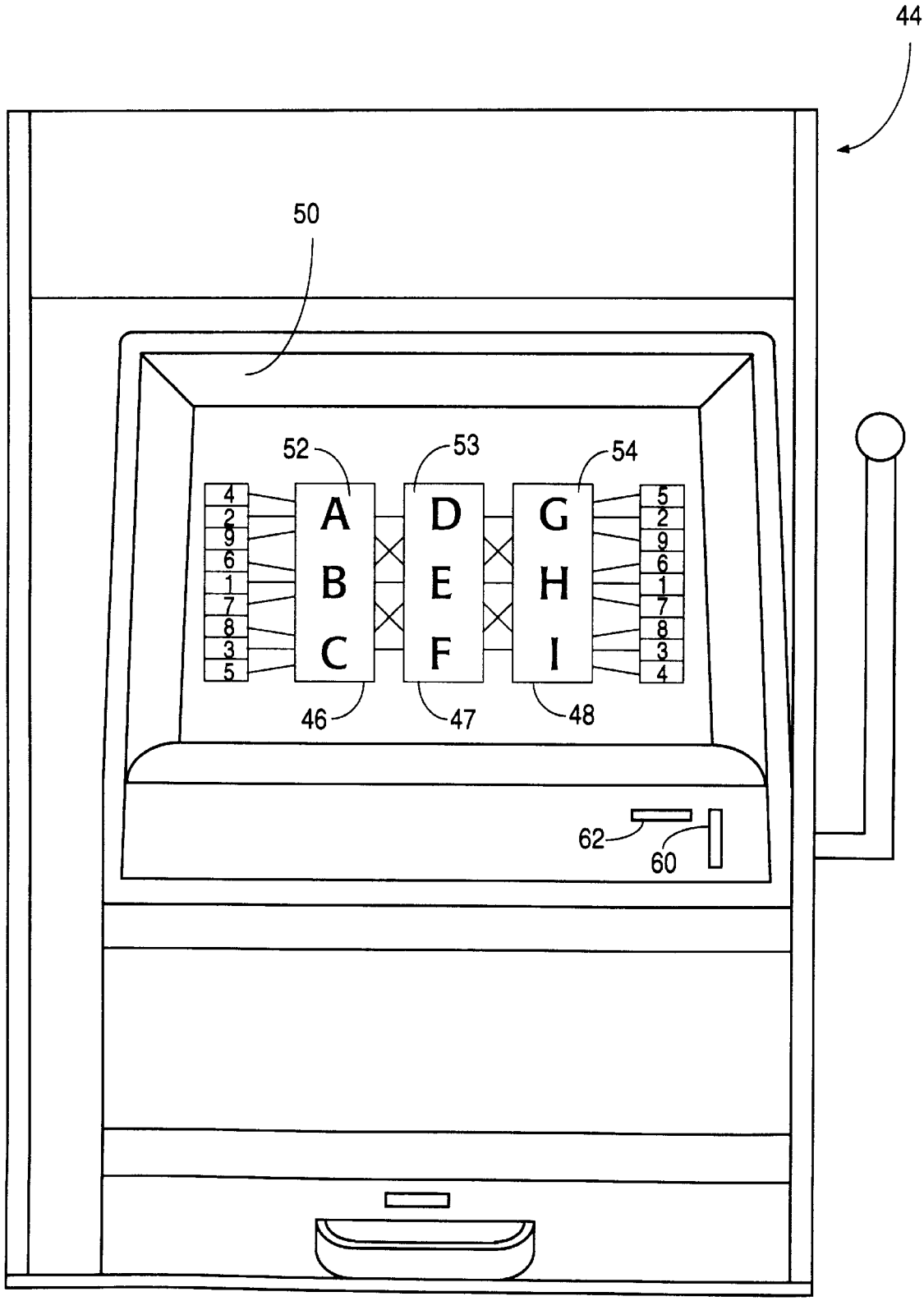
FIG. 4 is a front view of a slot machine incorporating the present invention.

FIG. 4 illustrates a slot machine 44 having three transparent portions 46, 47, 48 of a display glass 50 in front of three rotating reels 52, 53, and 54. The circuitry in such a slot machine 44 may be similar to that illustrated in FIG. 1, with the difference being a slightly different software program stored in the program ROM 20 and the pay-table ROM 26. Accordingly, only the differences between a conventional slot machine and the present invention need be described in order to fully enable one skilled in the art to carry out the best mode of the present invention.

In FIG. 4, three consecutive symbol positions of each of three reels 52, 53, 54 are exposed through the transparent portion 46, 47, 48 of the display glass 50 mounted on the front of the slot machine 44. A typical reel will have 22 symbols printed around its periphery, with some symbols being identical to other symbols on the same reel. Different combinations of symbols across the three reels generate different award amounts depending upon the probability of occurrence of the specific combinations of symbols.

Figure 5:
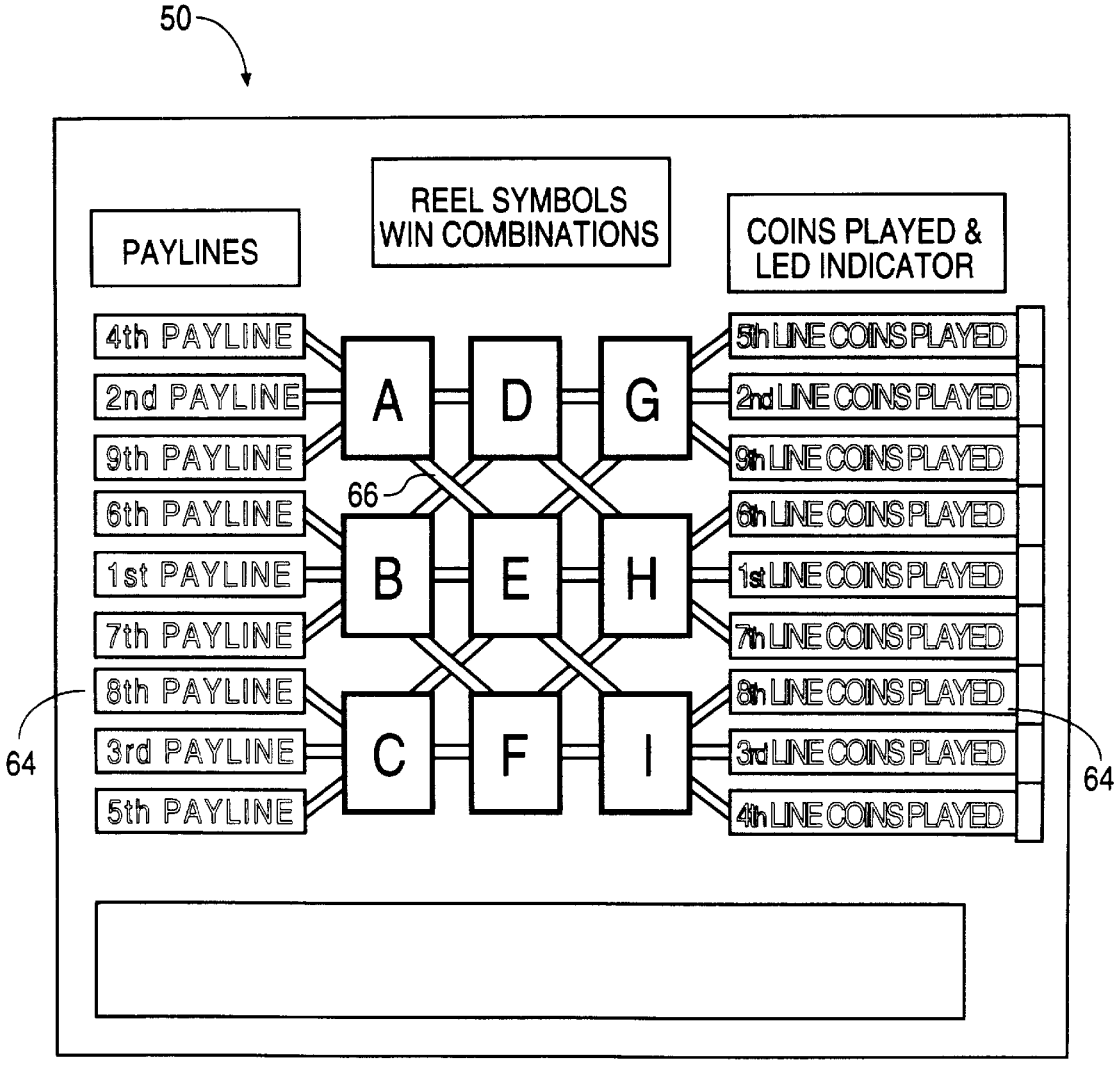
FIG. 5 shows the display portion of the preferred slot machine.
Figure 6A:
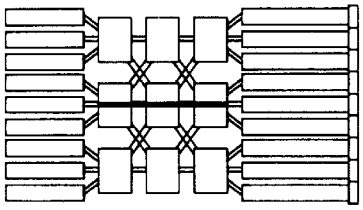
FIGS. 6A–6I illustrate the nine possible paylines in the preferred slot machine.
Figure 6B:
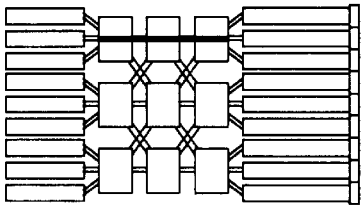
Figure 6C:
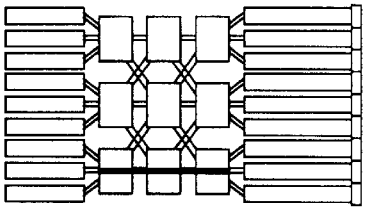
Figure 6D:
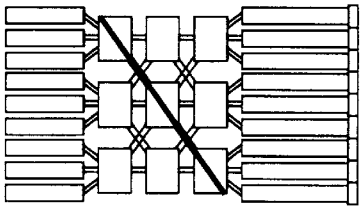
Figure 6E:
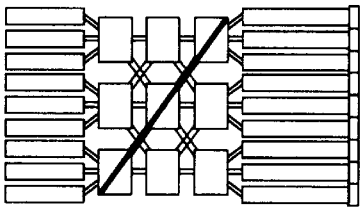
Figure 6F:
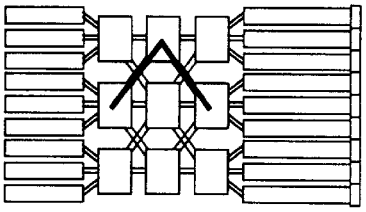
Figure 6G:
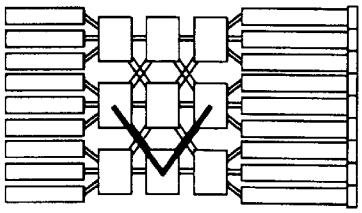
Figure 6H:
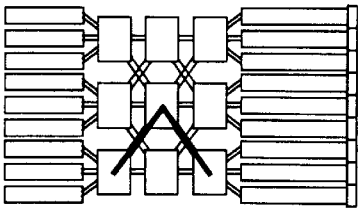
Figure 6I:
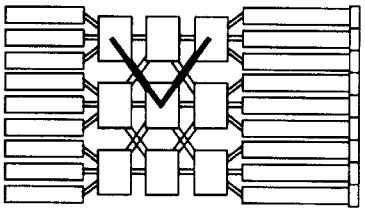

Symbol positions A, B, and C are shown for reel 52, symbol positions D, E, and F are shown for reel 53, and symbol positions G, H, and I are shown for reel 54, providing a 3-by-3 array of symbols. FIG. 5 shows additional detail of the display portion of the slot machine 44.

After the player has inserted anywhere from 1 to 9coins and has initiated a game so that the reels have spun and randomly stopped, combinations of the displayed symbols along the bold stripe paylines shown in FIGS. 6A–6I are detected to determine if the player has won. These symbol position combinations are identified below in Table I.

TABLE I

| | |
|---|---|
| Payline 1 (1 coin) | -- BEH |
| Payline 2 (2 coins) | -- ADG |
| Payline 3 (3 coins) | -- CFI |
| Payline 4 (4 coins) | -- AEI |
| Payline 5 (5 coins) | -- CEG |
| Payline 6 (6 coins) | -- BDH |
| Payline 7 (7 coins) | -- BFH |
| Payline 8 (8 coins) | -- CEI |
| Payline 9 (9 coins) | -- AEG |

In the preferred embodiment, the player obtains the benefit of each successive payline (one through nine) by inserting an additional coin in the coin slot of the slot machine or by playing an additional credit. Slot machine 44 in FIG. 4 shows a coin slot 60 and a paper money slot 62. After nine coins are deposited, additional coins will act to multiply the payout, starting with the first payline. In the preferred embodiment, up to five coins per payline may be played. In other embodiments, two, three, or four coins may be the maximum bet per payline.

It is understood that any combination of symbols in a payline may constitute a win, as determined by the pay-table ROM 26 (FIG. 1), as long as the player has inserted a sufficient number of coins to activate that payline.

In the preferred embodiment, there are also special symbols which may act as a wild card to represent any symbol. It is understood that a blank may also constitute a symbol, and an award may be granted by a symbol combination requiring only one or two symbols in the combination for a win.

The display glass 50 shown in FIG. 5 may be located directly in front of the reels, to reveal the actual reel symbols generated, or may be a top glass above the reels. In either configuration, the display glass 50 identifies to the player the paylines activated. The number of coins played and the corresponding payline are identified with the same color, such as yellow, red, blue, etc. Accordingly, as each coin is deposited, a light is illuminated behind the associated payline indicator 64 of the display glass 50 to indicate to the player the number of coins played and which payline(s) applies to the current game. Colored lines 66 connecting the symbol positions A–I may also be illuminated to identify the activated paylines to more easily enable the player to identify the symbol positions corresponding to that payline.

In one embodiment, a winning combination of symbols results in the flashing of the particular interconnecting lines 66 or the payline indicator 64 connecting the winning symbols. Multiple paylines may contain winning combinations of symbols. In the preferred embodiment, the player is paid for all winning combinations.

Figure 1:
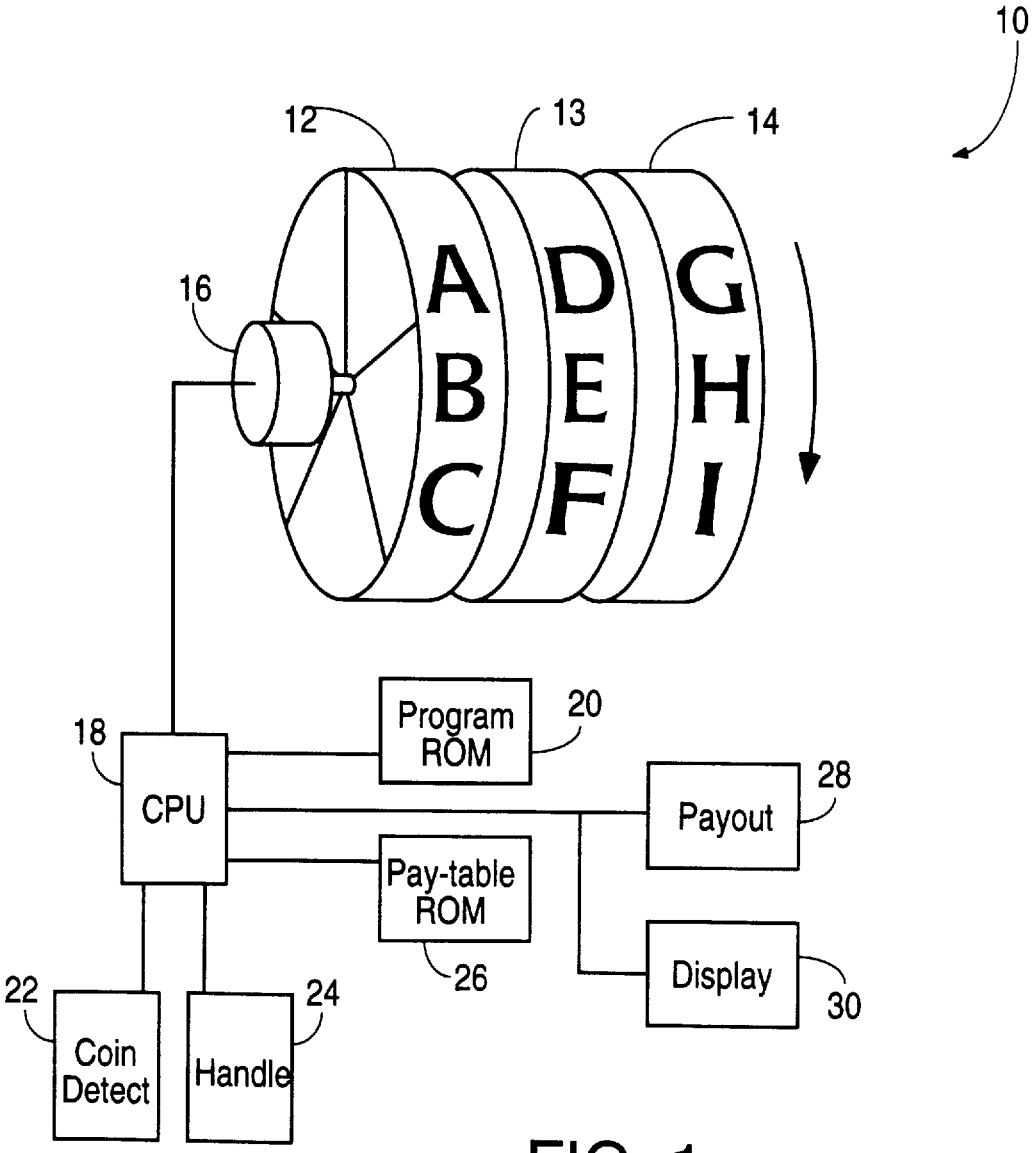
FIG. 1 illustrates well-known circuitry for operating a slot machine, which may include a prior art slot machine or the slot machine of the present invention.
Figure 2:
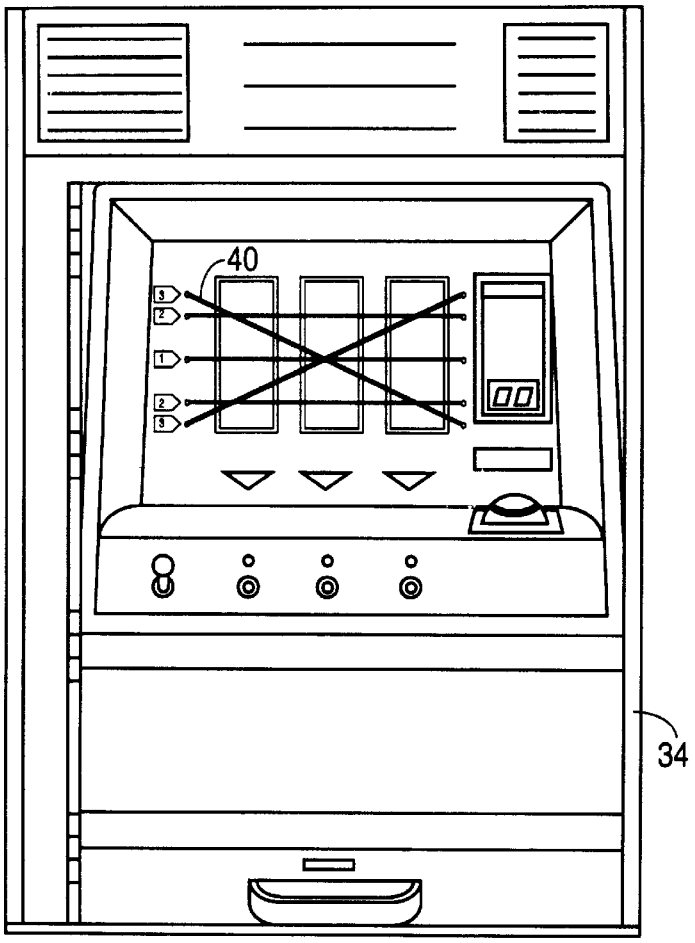
FIG. 2 (PRIOR ART)
FIG. 2 is a front view of a prior art slot machine having five paylines.
Figure 3:
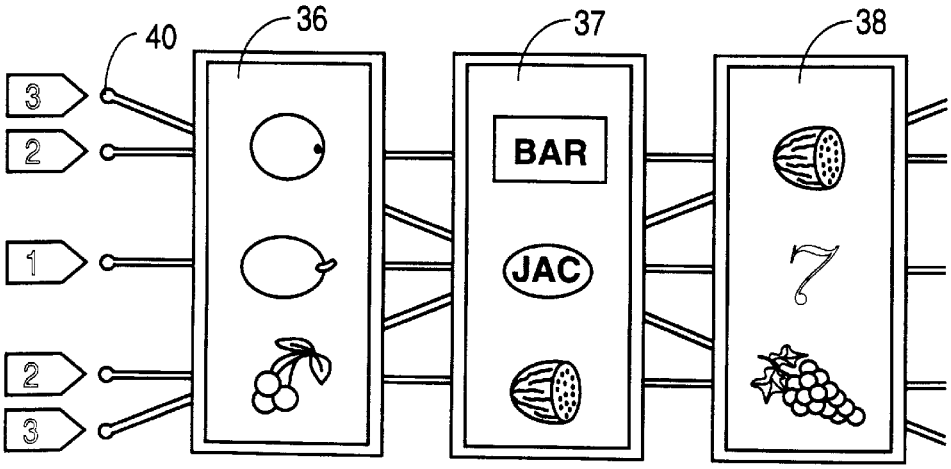
FIG. 3 (PRIOR ART)
FIG. 3 shows detail of the display portion of the slot machine of FIG. 2.

One skilled in the art would understand how to modify the existing programs in the program ROM 20 and the pay-table ROM 26 in FIG. 1 to carry out the present invention.

Figure 7:
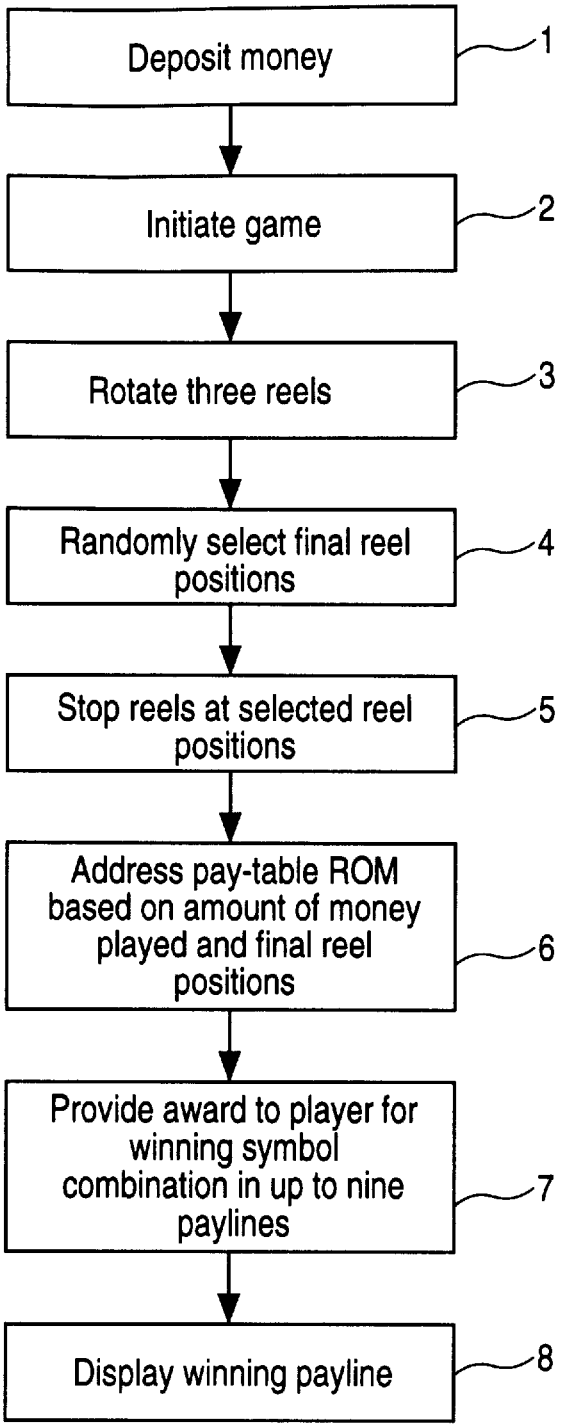
FIG. 7 is a flow diagram illustrating the basic steps carried out by the slot machine in accordance with the present invention.

FIG. 7 illustrates the basic process carried out by the slot machine in accordance with one embodiment of the invention. In Step 1, money is deposited in the slot machine. In Step 2, the player initiates a game by pulling a handle or pressing a button. In Step 3, the reels are rotated. In Step 4, the final reel positions are selected by a random number generator. In Step 5, the reels are stopped at their predetermined positions. In Step 6, the final reel positions are sensed by either counting the pulses to stepper motors 16 (FIG. 1) or by otherwise detecting the physical positions of the reels 12, 13, and 14. The final reel positions are conveyed from the CPU 18 in FIG. 1 to the pay-table ROM 26 along with an indication of the number of coins played. In Step 7, the pay-table ROM 26 uses the combination of the reel positions and the number of coins played as an address to identify the monetary payout to the player and to control the lamps (Step 8) behind the display glass 50 to flash the applicable payline associated with the winning symbol combination.

Accordingly, modifications to a conventional slot machine, such as shown in FIG. 1, have been described which enable a player to select up to nine paylines and which convey to the player the winning payline. While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

What is claimed is:

1. A slot machine comprising:

three rotable reels, each reel having a plurality of symbols printed thereon;

at least one motor and control circuitry for rotating said reels and stopping said reels such that three symbols on each reel are displayed to a player of the slot machine to create a 3-by-3 array of displayed symbols;

circuitry for activating up to nine paylines along said 3-by-3 array, each payline identifying a unique combination of three symbol positions, wherein said 3-by-3 array consists of a middle row, a top row, and a bottom row of symbols, each row consisting of a middle symbol, a left end symbol, and a right end symbol, said nine paylines consisting of:

a middle row of three symbols;

a top row of three symbols;

a bottom row of three symbols;

a diagonal row of three symbols consisting of a left end symbol in said bottom row, a middle symbol in said middle row, and a right end symbol in said top row;

a diagonal row of three symbols consisting of a left end symbol in said top row, said middle symbol in said middle row, and a right end symbol in said bottom row;

a left end symbol in said middle row, a middle symbol in said top row, and a right end symbol in said middle row;

said left end symbol in said middle row, a middle symbol in said bottom row, and said right end symbol in said middle row;

said left end symbol in said bottom row, said middle symbol in said middle row, and said right end symbol in said bottom row; and said left end symbol in said top row, said middle symbol in said middle row, and said right end symbol in said top row; and an award means for awarding a payment to said player for specified combinations of symbols in said 3-by-3 array along at least one of said nine paylines.

2. The machine of claim 1 further comprising a translucent display glass mounted on a front of said slot machine and an illumination means behind said display glass for illuminating a payline indicator indicating which of nine paylines are activated for a particular play of said slot machine.

3. The machine of claim 1 wherein said means for activating up to nine paylines comprises a monetary detector for detecting a number of monetary units played for a particular spin of said reels, said monetary detector successively activating said paylines from one through nine based on the number of monetary units played.

4. A method performed by a slot machine comprising the steps of:

activating up to nine paylines across a 3-by-3 array of symbol positions, each payline identifying a unique combination of three symbol positions;

rotating three reels of said machine;

stopping said reels to reveal three symbols on each reel to a player to form said 3-by-3 array of symbols displayed, wherein said 3-by-3 array consists of a middle row, a top row, and a bottom row of symbols, each row consisting of a middle symbol, a left end symbol, and a right end symbol, said nine paylines consisting of:

a middle row of three symbols;

a top row of three symbols:

a bottom row of three symbols;

a diagonal row of three symbols consisting of a left end symbol in said bottom row, a middle symbol in said middle row, and a right end symbol in said top row;

a diagonal row of three symbols consisting of a left end symbol in said top row, said middle symbol in said middle row, and a right end symbol in said bottom row;

a left end symbol in said middle row, a middle symbol in said top row, and a right end symbol in said middle row;

said left end symbol in said middle row, a middle symbol in said bottom row, and said right end symbol in said middle row;

said left end symbol in said bottom row. said middle symbol in said middle row, and said right end symbol in said bottom row, and said left end symbol in said top row. said middle symbol in said middle row, and said right end symbol in said top row;

detecting whether a winning combination of symbols is displayed in any activated one of said nine paylines; and in response to a winning combination of symbols in said any activated one of said nine paylines, awarding a player a corresponding amount.

5. The method of claim 4 wherein said step of activating comprises detecting monetary units played for a particular spin of said reels and successively activating said paylines from one through nine based on the number of monetary units played.

* * * * *